US011890669B2

(12) United States Patent
Gröschel

(10) Patent No.: US 11,890,669 B2
(45) Date of Patent: Feb. 6, 2024

(54) METHOD FOR PRODUCING A LOST CASTING CORE

(71) Applicant: Nemak, S.A.B. de C.V., Nuevo Leon (MX)

(72) Inventor: Andre Gröschel, Niederneukirchen (AT)

(73) Assignee: Nemak, S.A.B. de C.V., Nuevo Leon (MX)

( * ) Notice: Subject to any disclaimer, the term of this patent is extended or adjusted under 35 U.S.C. 154(b) by 0 days.

(21) Appl. No.: 17/614,872

(22) PCT Filed: May 19, 2020

(86) PCT No.: PCT/IB2020/054721
§ 371 (c)(1),
(2) Date: Nov. 29, 2021

(87) PCT Pub. No.: WO2020/240342
PCT Pub. Date: Dec. 3, 2020

(65) Prior Publication Data

US 2022/0234096 A1 Jul. 28, 2022

(30) Foreign Application Priority Data

May 29, 2019 (DE) ..... 10 2019 114 493.0

(51) Int. Cl.
*B22C 9/10* (2006.01)
*B22C 7/06* (2006.01)
*B22C 13/16* (2006.01)

(52) U.S. Cl.
CPC ..... *B22C 9/103* (2013.01); *B22C 7/06* (2013.01); *B22C 13/16* (2013.01)

(58) Field of Classification Search
CPC .. B22C 7/06; B22C 9/10; B22C 9/103; B22C 9/106; B22C 13/00; B22C 13/12; B22C 13/16
USPC ..... 164/137, 369, 23, 28, 228
See application file for complete search history.

(56) References Cited

U.S. PATENT DOCUMENTS

| | | | |
|---|---|---|---|
| 2008/0017346 | A1 | 1/2008 | Bassi |
| 2012/0285648 | A1 | 11/2012 | Mueller et al. |
| 2013/0081774 | A1 | 4/2013 | Mueller et al. |

FOREIGN PATENT DOCUMENTS

| | | | |
|---|---|---|---|
| EP | 1134048 | A1 | 9/2001 |
| EP | 1721688 | A1 | 11/2006 |
| WO | 0013819 | A1 | 3/2000 |

*Primary Examiner* — Kevin P Kerns
(74) *Attorney, Agent, or Firm* — The Webb Law Firm

(57) ABSTRACT

A method for producing a casting core including: producing a casting core insert having a side surface section that is equal to a corresponding section of a side surface of the casting core from a casting core molding material; positioning the casting core insert in a mold cavity of a core box with the side surface section of the casting core insert in the place of the corresponding section of the side surface of the finished casting core, wherein a parting plane intersects the side surface section; introducing a casting core molding material into the mold cavity of the core box to form the remainder of the casting core, wherein the introduced casting core molding material comes into contact with the casting core insert; and solidifying the casting core molding material, thereby forming a shape-fit and/or material-fit connection between the introduced casting core molding material and the casting core insert.

8 Claims, 4 Drawing Sheets

METHOD FOR PRODUCING A LOST CASTING CORE

CROSS-REFERENCE TO RELATED APPLICATIONS

This application is the United States national phase of International Application No. PCT/IB2020/054721 filed May 19, 2020, and claims priority to German Patent Application No. 10 2019 114 493.0 filed May 29, 2019, the disclosures of which are hereby incorporated by reference in their entirety.

BACKGROUND OF THE INVENTION

1. Field of the Invention

The invention relates to a method for producing a lost casting core, which has a side surface, in a core box, which is composed of at least two core box parts, between which parts a parting plane runs when the core box is closed, and which box delimits a mold cavity that determines the shape of the casting core to be produced, and in which box an inner surface that reproduces the side surface of the casting core is provided, through which surface the parting plane of the core box runs.

2. Discussion of the Related Art

Casting cores of the type in question here are used in casting molds for casting technology production of cast parts produced from a metal melt, so as to reproduce structural elements, such as recesses, cavities, passages, channels and the like in the casting part in question. They are referred to as "lost parts" because they are destroyed when the cast part is unmolded from the corresponding casting mold. This makes it possible to reproduce structural elements of the stated type also in the interior of the cast part, by means of such casting cores. However, in the case of casting molds that are put together as what is called a "core package" they form the outer contour of the cast part.

The casting cores are produced in what are called "core shooters." These comprise a core box designed as a permanent mold for repeated use in series production, which box is divided horizontally, for example, into an upper and a lower core box part. However, in practice core boxes that are divided vertically or in which partings that run in the horizontal and the vertical direction are combined with one another are also in use.

The core box delimits, with its core box parts, a mold cavity that reproduces the casting core. A molding material is introduced into this mold cavity when the core box is closed, by way of openings introduced into the core box, under pressure. This process is referred to as "core shooting." After introduction of the molding material into the mold cavity, hardening of the casting core in the core box takes place. Then the core box is opened by means of moving at least one of the core box parts, so as to remove the casting core.

Molding materials used for the production of casting cores of the type in question are usually mixed together from a basic molding material, for example an inorganic refractory mold sand, and a binder. In practice, inorganic or organic binders are used for this purpose. When using inorganic binders, hardening of the molding material in the core box takes place by means of supplying heat and extracting moisture (similar to what is called the "Hot Box method"), whereas when using organic binders, the cores are gassed with a reaction gas in the mold die, so as to bring about solidification by means of a chemical reaction of the binder with the reaction gas ("Cold Box method"). Molding materials based on both inorganic and organic binder systems are available on the market in many versions. In this regard, if necessary one or more additives can be mixed into the molding materials, so as to optimize the processing properties and the usage properties of the corresponding molding material itself or of the casting core formed from it.

The plane in which the separating join between the core box parts that lie against one another runs when the core box is closed, in each instance, is referred to as the "parting plane" or "separating plane" of a core box. Simply the circumstance that the core box must be opened to remove the finished casting core produced makes an at least two-part structure of the casting core necessary. In this regard, the parting plane between the core box parts must also necessarily run between the core box parts, so as to be able to remove the finished casting core from the mold cavity after removal of the one core box part. In this regard, core boxes that are composed of more than two core box parts are required for the production of more complex shaped casting cores, in particular of casting cores having undercuts, so as to allow destruction-free unmolding of the finished casting core. In the case of such multi-part core boxes, too, a parting plane is necessarily present, in each instance, between the core box parts that lie against one another when the core box is closed, along which plane the separation between the corresponding core box parts runs, and which plane cuts through the mold cavity.

The places where the corresponding parting plane intersects the mold cavity, in other words where the separating join between two box parts that runs in the parting plane meets the mold cavity, can be recognized on the finished cast part by means of what is called a "core dividing burr." This is a projection that typically runs in the manner of a line along the side surfaces of the casting core and has a distinctively configured burr progression, which generally tapers but is clearly marked, in any case. The core dividing burr arises from molding material that unavoidably penetrates into the separating joins between the box parts when the molding material is shot into the mold cavity of the core box.

In the case of a cast part that is cast using a casting core that has been produced in a core box, as has been explained above, the core dividing burr that is present on the casting core is formed as a notch-like depression that also runs like a line along the side surface of the structural element reproduced by means of the casting core, in each instance. In practical use of the cast part, stress peaks can occur at such a notch-like depression, and these can lead to crack formation, going as far as failure of the cast part. For this reason, it has been necessary until now to design cast parts, in those regions in which the core dividing burr of the corresponding casting core leaves an undesirable but unavoidable depression, caused by production technology, during production, in such a manner that they can reliably withstand the stresses that occur in practice, in spite of the depression in question.

However, in the case of particularly delicately shaped cast parts that are subject to great stress in practice, such as cylinder heads for high-compression internal combustion engines or the like, which are cast from light-metal material and in which only minimal wall thicknesses of the cast part are permitted due to their design and function, such dimensioning is frequently not possible.

Attempts have been made to minimize the weakening of cast parts that is caused by the formation of core dividing burrs on casting cores by means of additional sealing of the separating joins between the core box parts, in particular at the transition to the mold cavity, using a filling compound. However, not only are there narrow limits set for this measure, not only as a consequence of the restricted accessibility of the mold cavity, but rather it also proves to be unreliable for the process in large-scale mass production, since it cannot be guaranteed with sufficient reliability that on the one hand, the separating joins will in fact be closed with a sufficient seal, and, on the other hand, no filling compound will get into the mold cavity, and the precision with which the molding casting core is reproduced is impaired. Likewise, it proves to be impossible or only possible with extreme effort to lay out the parting planes and thereby the separating joins of a core box in such a manner that the casting core burr runs at a location at which it does not lead to any impairment of the usage properties on the cast part to be formed using the casting core in question, or can be easily taken into consideration in the design of the cast part.

Against this background, the task has arisen of indicating a method with which it is possible, using simple means, to produce a casting core that is perfectly burr-free even on a side surface that is intersected by a parting plane of the core box in the case of the casting core that lies in the corresponding core box, or at which a separating join of the core box ends.

SUMMARY OF THE INVENTION

The invention has accomplished this task in that during the production of a lost casting core, at least the work steps as described herein are carried out.

In this regard, it is understood that when carrying out the method according to the invention, a person skilled in the art will not only complete the method steps mentioned in the claims and explained here, but rather will carry out all other steps and activities that are regularly carried out during practical implementation of such a method in the state of the art, if the need for this arises.

Advantageous embodiments of the invention are indicated in the dependent claims and will be explained in detail below, as will the general idea of the invention.

A method according to the invention for producing a lost casting core, which has a side surface, in a box, which is composed of at least two core box parts, between which a parting plane runs when the core box is closed, and which box delimits a mold cavity, which determines the shape of the casting core to be produced, and in which box an inner surface that reproduces the side surface of the casting core is provided, through which surface the parting plane of the core box runs, accordingly comprises the following work steps:

(a) producing a casting core insert in one piece from a casting core molding material, which is mixed together from a basic molding material and a binder, as well as, optionally, from one or more additives, wherein the casting core insert corresponds to a section of the casting core to be produced, and wherein the casting core insert carries at least one side surface section that is equal to a corresponding section of the side surface of the casting core to be produced;

(b) positioning the casting core insert in the mold cavity of the core box in a position in which the casting core insert takes the place, with its side surface section, which the corresponding section of the side surface of the casting core takes in the finished, produced casting core, wherein the parting plane of the core box runs through the side surface section of the casting core insert positioned in the core box;

(c) introducing a casting core molding material, which is mixed together from a basic molding material and a binder, as well as, optionally, from one or more additives, into the mold cavity of the core box, so as to produce the remaining casting core, wherein the casting core molding material that penetrates into the mold cavity comes into contact with the casting core insert that sits in the mold cavity;

(d) solidifying the casting core molding material that was introduced into the mold cavity, thereby forming a shape-fit and/or material-fit connection between the casting core molding material that was introduced into the mold cavity and the casting core insert.

The method according to the invention is therefore based on the idea of first pre-fabricating a casting core insert (work step (a)), which is formed, like the casting core obtained at the end of the method, from molding material, and is destroyed during unmolding of the cast part. Because of its separate pre-fabrication, the casting core insert can easily be formed in such a manner that it is perfectly shaped in accordance with the design requirements in the region of its side surface section, at which a casting core burr is not allowed to be present under any circumstances. Thus, a casting core insert pre-fabricated according to the invention has no unwanted deviations from its intended shape, such as peaks or depressions, in particular in the region of its side surface sections that must be kept free of such shape defects, which would leave the same shape defects on the cast part that is later cast using the casting core produced according to the invention, and the cast part could be weakened by them.

The casting core insert that is pre-fabricated in work step (a) and perfectly meets the requirements in the region of its critical side surface section is positioned, in work step (b), at the location within the mold cavity of the core box at which the burr-free side surface of the casting core is supposed to be located on the finished, produced casting core. When the core box is closed, the side surface section of the casting core insert lies tightly against the assigned inner surface of the mold cavity, due to the fact that it perfectly corresponds to the design defaults of the design of the casting core, and covers the mouth region that is present there, in which the separating join, which lies in the parting plane that intersects the mold cavity, meets the mold cavity.

When subsequently the casting core molding material, which forms the remaining part of the casting core to be produced, which is not taken up by the casting core insert, is introduced into the mold cavity (work step (c)), the casting core insert blocks the path to the mouth region of the separating join in question. Instead, the casting core molding material hits the outer surfaces of the casting core insert, which face the mold cavity, which has been open until then. In this manner, the casting core molding material that flows into the mold cavity sheathes the casting core insert, wherein the side surface section of the casting core insert that lies against the inner surface section that forms the boundary of the mold cavity remains unwetted by the casting core molding material.

After the remaining part of the casting core molding material that forms the casting core has been filled into the mold cavity, the casting core insert is embedded in the casting core molding material, and there is intensive contact between the casting core molding material that has been introduced and the side surfaces of the casting core insert assigned to the mold cavity. This connection is supported in that the casting core molding material is introduced into the mold cavity of the core box in a conventional manner, at a high "shooting pressure" that is also selected in a conventional manner. As a result of the intensive contact between the casting core insert and the casting core molding material that is achieved in this manner, an equally intensive shape-fit and/or material-fit connection occurs between the casting core molding material introduced into the mold cavity and the casting core insert in the case of the subsequent casting core molding material, and as a result, after completion of the solidification process (work step (d)), the casting core insert is firmly and permanently securely held in the casting core that is obtained.

In the method according to the invention, the formation of a dividing burr on the casting core to be produced is prevented in that a casting core insert is pre-formed for the critical region, which insert takes up a partial volume of the casting core to be produced. This casting core insert is completely hardened and then inserted into the mold cavity of the core box intended for producing the casting core. Thereupon the casting core is finished and formed in a usual manner, by means of introducing casting core molding material into the mold cavity of the core box. In this regard, casting core molding material flows around the casting core insert, and intensive shape-fit clamping of the casting core molding material onto the surface of the casting core insert takes place. In that a suitable binder is selected for the casting core molding material or the molding material of the casting core insert, the result can furthermore be achieved that as a consequence of the hardening of the casting core molding material, a material bond also occurs, at least in part. Binder components of the casting core molding material that lie against the casting core insert connect, in this case, with the pre-fabricated casting core insert, and thereby contribute to the secure hold of the casting core insert in the finished casting core.

Surprisingly, it has turned out here that in the case of a casting core obtained by means of the method according to the invention, no burr is present in the transition region in which the side surface section of the pre-fabricated casting core insert makes a transition to the further side surfaces of the casting core, which are formed by the molding material introduced into the mold cavity after positioning of the casting core insert, since the inner surface of the core box parts that delimit the mold cavity lies directly against the pre-shot core and seals it. A casting core burr occurs, at most, in the region in which the separating join that lies in the parting plane opens into the mold cavity outside of the side wall section of the casting core insert. However, since this burr lies outside of the zone that is critical for the component to be cast using the casting core, it can be accepted without problems.

The molding materials selected for the casting core insert and for the remaining volume of the casting core to be produced can be individually selected in such a manner that they optimally correspond to the requirements set for the casting core insert, on the one hand, and the remaining part of the casting core, on the other hand. For example, the molding material from which the casting core is formed can differ from the casting core molding material from which the remaining casting core is formed. In this regard, it is conceivable, for example, to use a molding material for the casting core insert that is suitable for reproducing particularly smooth, defect-free surfaces on the cast part, while a less high-quality casting core molding material can be used for the remaining casting core, if the demands made on the precision of the shape reproduction or the surface quality of the remaining casting core are lower.

It proves to be advantageous with regard to the preparation and reusability of the molding materials used for producing the casting core insert and the remaining casting core if the molding material from which the casting core insert is formed is the same as the casting core molding material from which the remaining casting core is formed.

Connection of the casting core insert to the remaining part of the casting core, which is subsequently formed onto the casting core insert, can be achieved in that during production (work step (a)) of the casting core insert, it is given a surface structure that has projections, recesses and/or undercuts on its surface sections that come into contact with the casting core molding material that forms the remaining casting core, at which surface shape-fit coupling of the casting core insert to the molding material of the remaining casting core occurs when the casting molding material introduced into the core box makes contact with the corresponding surface sections in work step (c).

From an economic and production technology point of view, it is particularly advantageous that the method according to the invention can easily be used in conventional core-shooting machines that are already on the market, without the design of the core boxes used in these machines having to be changed. In this regard, the casting core insert provided according to the invention can be produced in a separate work process, on a separately provided production device.

A particularly efficient version of the method according to the invention, which is advantageous in series production, can be implemented in that the work steps (a)-(d) are repeatedly carried out in a serial sequence, and the core box comprises, in addition to the mold cavity in which the casting core insert is positioned in the one pass of the work step sequence (a)-(d) (work step (b)) and subsequently the casting core to be produced is finish-formed by means of introduction of the molding material (work step (c)), an additional mold cavity in which the new casting core insert is formed, at the same time when the molding material is filled into the mold cavity provided for the casting core (work step (c)), which insert is required for the next pass to be carried out (work step (a) of the subsequent pass of the work steps (a)-(d)). In this embodiment, therefore, one casting core insert is pre-fabricated and one casting core is completed, in each instance, in the same core box, wherein the pre-fabricated casting core insert is intended, in each instance, for the subsequent pass of the method according to the invention, which is carried out. In this manner, a casting core insert always stands ready for production of a casting core, according to the invention, with minimized effort and optimized short cycle times, during continuous mass production.

In order to ensure, in the case of an automated production sequence, that defects are recognized during insertion of the casting core insert, in particular that it is reliably recognized if, for example due to a problem in making a pre-fabricated casting core insert, no casting core insert has been inserted into the casting mold, the volume of casting core molding material that is introduced into the mold cavity of the core box during work step (c) can be detected, and an alarm signal can be issued if the introduced volume exceeds a limit value. In this regard, exceeding the limit value indicates that the additional empty volume in the mold cavity of the core box that exists because the casting core insert is not present has been filled with casting core molding material, something that is impermissible, since the casting core produced in this manner will unavoidably have a casting core burr on the critical side wall surface.

Another possibility for recognizing cases in which the casting core insert has not been positioned or has been incorrectly positioned in the mold cavity in work step (b) consists in providing a monitoring molded element, such as a recess, a projection or a foreign body in the mold cavity, which element, after positioning of the casting core insert (work step (b)) in the mold cavity, is shielded with regard to the remaining part of the mold cavity by means of the casting core insert, that monitoring takes place as to whether a molded element is reproduced on the casting core obtained after work step (d), which element corresponds, at least in certain sections, to the monitoring molded element provided in the mold cavity, and that in the event that such a molded element is found on the casting core obtained, this casting core is sorted out as a defective part. With this way of securing the process, an additional molded element is therefore provided in the mold cavity of the core box, which element can be a recess, a projection, a foreign body, a collection of pigment or the like. If the casting core insert is properly seated in the mold cavity, the casting core insert prevents the molding material introduced into the mold cavity for completion of the casting core from reaching the monitoring molded element. If, in contrast, the casting core insert is missing or if the casting core insert is not correctly positioned in the mold cavity, then the molding material advances all the way to the monitoring molded element in question when the mold cavity is filled. As a consequence of this, there is a molded element on a casting core, during the production of which the casting core insert was missing or incorrectly positioned, which element represents a negative of the monitoring molded element, at least as a fragment, and that would not be present, in any case, if, for the production of the casting core in question, a casting core insert had been properly positioned before introduction of the molding material (work step (c)).

BRIEF DESCRIPTION OF THE DRAWINGS

In the following, the invention will be explained in greater detail using a drawing that shows an exemplary embodiment. The figures show, schematically, in each instance.

DETAILED DESCRIPTION OF THE INVENTION

Figure 6:
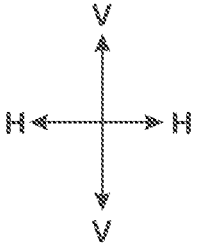
FIG. 6 a casting core obtained after hardening of the casting core molding material and opening of the core box according to FIG. 5, in a sectional representation corresponding to FIG. 1.
Figure 6:
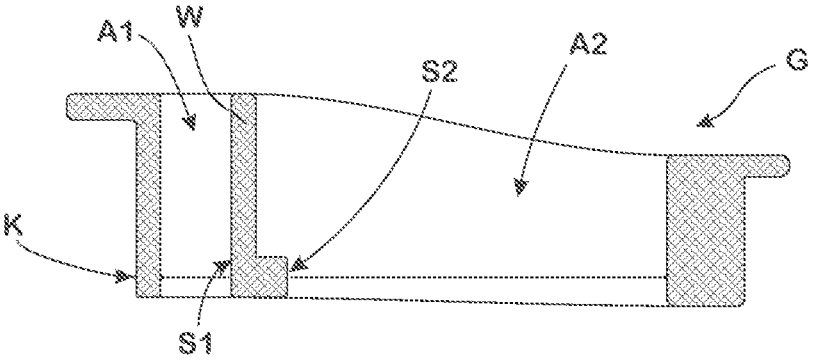
Figure 7:
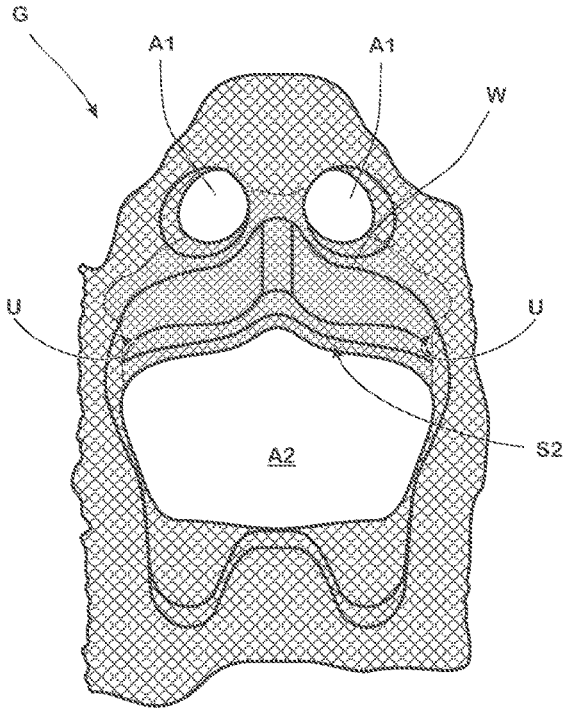
FIG. 7 a casting core insert in a perspective view.
Figure 8:
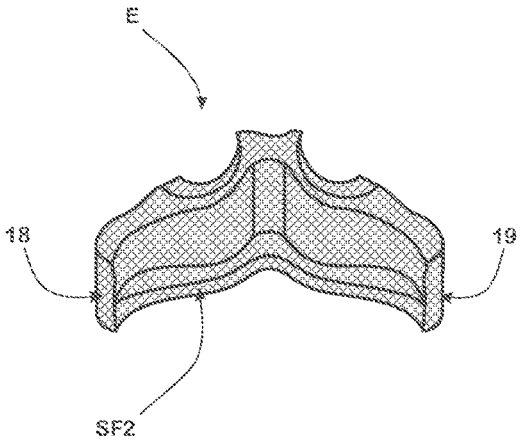
FIG. 8 a casting core in a perspective view corresponding to FIG. 7.

For the production of a casting core G shown schematically in FIG. 6, in a sectional representation, and in greater detail in FIGS. 7 and 8, a core box 1 is made available in a conventional core-shooter, not shown in any detail here, which box comprises an upper core box part 2 and a lower core box part 3.

In the upper and lower core boxes 1, recesses 4, 5, 6, 7 are formed, in each instance, of which the recess 4 of the upper core box part 2 and the recess 5 of the lower core box part 3 jointly form a mold cavity 8 when the core box 1 is closed (FIG. 4, 5), the shape of which cavity corresponds to a negative of the casting core G to be produced. The recess 6 of the upper core box part 2 and the recess 7 of the lower core box part 3, in contrast, form an additional mold cavity 9 when the core box 1 is closed, which cavity is independent of the first mold cavity 8 and represents a negative of a casting core insert E.

A separating join 10 runs between the core box parts 2, 3, which sit one on top of the other, in a parting plane T that extends horizontally here and intersects the mold cavities 8, 9. The separating join 10 opens, in each instance, into the mold cavities 8, 9.

Filling openings 11, 12, 13 are formed in the upper core box part 2, in a known manner. To fill casting core molding material F into the mold cavities 8, 9, shooting nozzles, not shown here, move into the filling openings 11-13 in a known manner, by way of which openings the casting core molding material F is shot in. Likewise in a known manner, ejectors, not shown here, are provided in the lower core box part 3, which eject the completed casting core G, in each instance, from the core box 1, which is then open.

For the casting core G, the provision applies that it is not allowed to have a casting core burr K on the side surfaces S1, S2 of a wall W that separates the recesses A1, A2 of the casting core G and is arranged in the interior of the casting core G, after unmolding from the core box 1, even if the recesses 4, 5 that mold the wall W on the casting core G to be produced are intersected by the parting plane T, so that the separating join 10 opens into the inner surfaces 14, 15 of the mold cavity 8 of the core box 1 that mold the side surfaces S1, S2 of the casting core G.

In order to fulfill this provision, a casting core insert E has been produced in the mold cavity 9 of the core box 1 in a separate work step. The shape of the mold cavity 9 corresponds to the shape of that section A of the mold cavity 8 in which the separating join 10 makes contact with the inner surfaces 14, 15 of the mold cavity 8, which surfaces reproduce the side surfaces S1, S2 on the casting core G. In this regard, the section A extends, proceeding from a thickened foot region, in the vertical direction, over about two-thirds of the height of the wall W of the casting core G to be produced, and in this regard covers the mouth region of the separating join 10.

In contrast to the section A of the mold cavity 8, however, the mold cavity 9 is oriented in such a manner that the parting plane T and, accordingly, the separating join 10 are oriented parallel to the inner surfaces 16, 17 of the mold cavity 9, which surfaces reproduce the flat side surface sections SF1, SF2 of the casting core insert E, which sections lie on opposite sides of the casting core insert E. The parting plane T and the separating join 10 therefore intersect the mold cavity 8, 9 not in the region of its inner surfaces 16, 17, which are oriented in the horizontal direction H here, but rather in the region of its narrow sides 18, 19, which extend in the vertical direction V.

Figure 1:
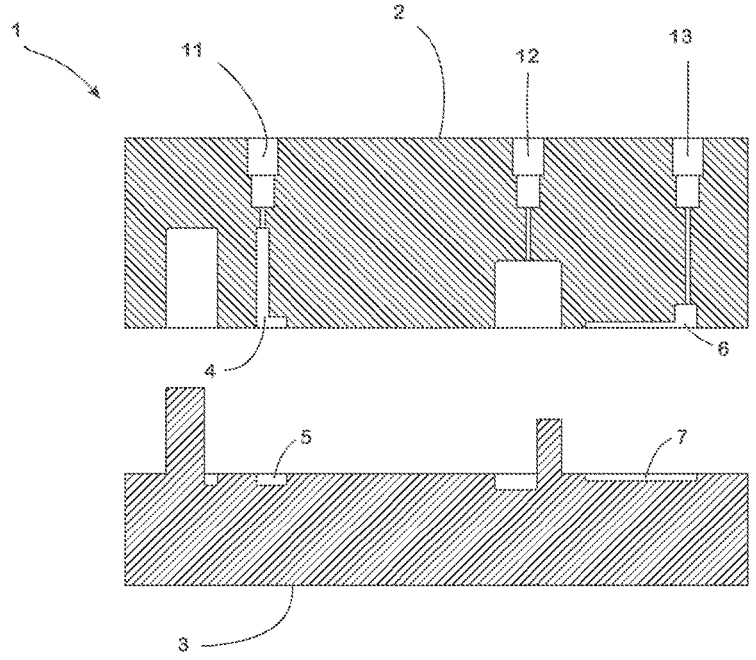
FIG. 1 a core box in the open position, in longitudinal section.
Figure 2:
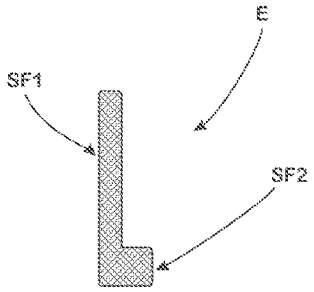
FIG. 2 a casting core insert in longitudinal section.
Figure 3:
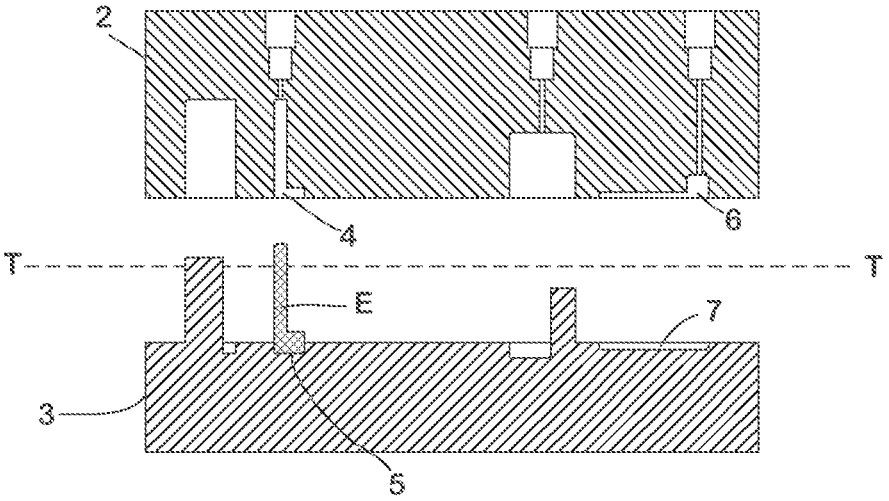
FIG. 3 the core box according to FIG. 1 in the open position, with a casting core insert according to FIG. 2 inserted into it, in a sectional representation corresponding to FIG. 1.

To produce the casting core G, the casting core insert E is set into the recess 4 formed in the lower core box part 3, in section A of the core box 1, with its thickened foot (FIG. 3).

Figure 4:
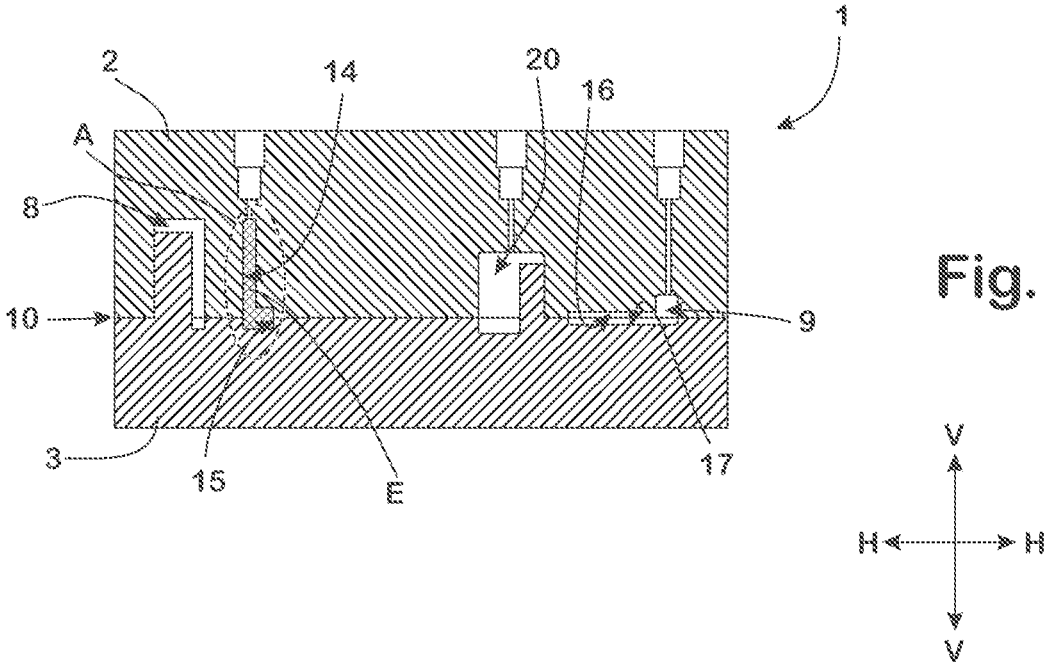
FIG. 4 the core box according to FIG. 3 in the closed position, in a sectional representation corresponding to FIG. 1.

Subsequently, the upper core box part 2 is lowered until it sits tightly on the lower core box part 3 (FIG. 4). When the core box 1 is closed, the casting core insert E completely takes up the section A of the mold cavity 8, and lies tightly against the assigned inner surface 14, 15 of the mold cavity 9, in each instance, with its side surface sections SF1, SF2. In this regard, the side surface sections SF1, SF2 of the casting core insert E cover the mouth regions of the separating join 10, so that these are shielded with regard to the open remaining region 20 of the mold cavity 8, which was still free of molding material until then.

Figure 5:
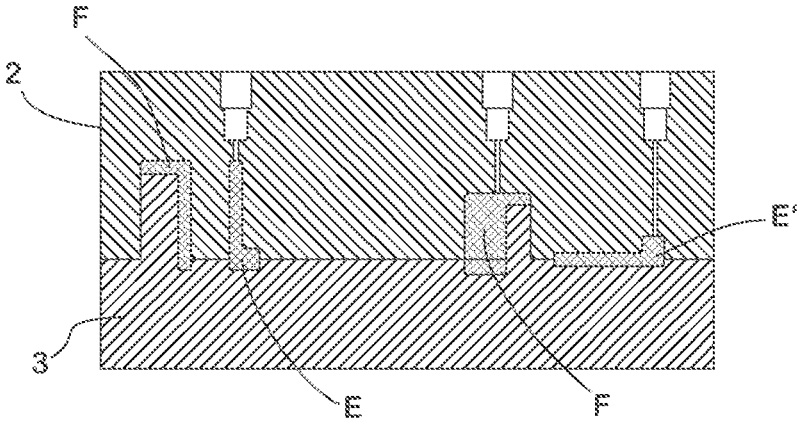
FIG. 5 the core box according to FIG. 4 in the closed position, after casting core molding material has been shot in, in a sectional representation corresponding to FIG. 1.

Subsequently, casting core molding material F is shot into the mold cavity 8 by means of the shooting nozzles already mentioned above, by way of the filling openings 11 and 12. The casting core molding material F fills the mold cavity 8 completely, and in this regard comes into contact with the narrow sides of the casting core insert E assigned to the open part of the mold cavity 8, so that after completion of the filling process, the casting core insert E is completely embedded in the casting core molding material F on its lateral narrows sides and at its top. At the same time that casting core molding material F is shot into the mold cavity 8, casting core molding material F is also shot into the mold cavity 9 for separate production of a new casting core insert E', until this cavity is completely filled (FIG. 5).

Subsequently, the casting core molding material F filled into the mold cavities 8, 9 is hardened by means of heat application, moisture extraction or gassing, depending on the binder system used, in each instance. In this regard, a shape-fit connection is formed between the casting core insert E and the casting core molding material F that lies against it, by the grains of the casting core insert E that engage into one another on the side surfaces, and by the casting core molding material F that forms the remaining part of the casting core G that was not taken up by the casting core insert E. At the same time, at least locally, shape-fit connections form between the casting core molding material F of the casting core insert E and the casting core molding material F filled into the mold cavity 8, as the result of adhesion of the binder that is present in the casting core molding material F filled into the mold cavity 8, to the molding material grains of the casting core insert E. In this manner, in the finished, hardened casting core G, the casting core insert E is firmly integrated into the casting core G.

The transition regions U, at which the side surface sections SF1, SF2 make a transition into the adjacent side surface sections SF1, SF2 of the casting core G, are free of fissures or other uneven regions in this regard. Likewise, the side surface sections SF1, SF2 are completely burr-free, in accordance with the demands made on them. In contrast, a casting core burr K forms on the remaining surfaces not taken up by the side surface sections SF1, SF2 of the casting core insert E, where the separating join 10 opens into the mold cavity 8, in each instance.

The casting core insert E' produced simultaneously with the casting core G is available for a further pass of the method described here, in which pass a further casting core G is produced, using the casting core insert E in question, which was pre-fabricated independently of it.

In the present example, the same commercially available casting core molding material F was used for the production of the casting core G and of the casting core insert E, which material was mixed together, in a known manner, from a molding sand, an organic or inorganic binder, and additives. Because of the completely independent production, however, a different molding material could also have been used for the production of the casting core insert E, for example so as to achieve a specific surface quality in the region of the side surface sections SF1, SF2.

REFERENCE SYMBOLS

1 core box
2 upper core box part of the core box 1
3 lower core box part of the core box 1
4-7 recesses of the upper and lower core box part 2, 3
8 first mold cavity of the core box 1
9 additional mold cavity of the core box 1
10 separating join of the core box 1
11-13 filling opening of the upper core box part 2
14, 15 inner surfaces of the mold cavity 8
16, 17 inner surfaces of the mold cavity 9
18, 19 narrow sides of the casting core insert E
20 free remaining region of the mold cavity
A section of the of the mold cavity 8 taken up by the casting core insert E
A1, A2 recesses of the casting core G
E casting core insert
E' newly produced casting core insert
H horizontal direction
F casting core molding material
G casting core
K casting core burr
S1, S2 side surfaces of the wall W of the casting core G
SF1, SF2 side surface sections of the casting core insert E
T parting plane of the core box 1
U transition regions U at which the side surface section SF1, SF2 make a transition into the adjacent side surface sections SF1, SF2 of the casting core G
V vertical direction
W wall of the casting core G

The invention claimed is:

1. A method for producing a lost casting core (G), which has a side surface (S1, S2), in a core box (1) that is composed of at least two core box parts (2, 3), between which parts a parting plane (T) runs when the core box (1) is closed, wherein the core box delimits a mold cavity (8) that determines a shape of the casting core (G) to be produced, an inner surface (14, 15) that reproduces the side surface (S1, S2) of the casting core (G) is provided in the core box, and the parting plane (T) of the core box (1) runs through the inner surface, the method comprising:

(a) producing a casting core insert (E) in one piece from a casting core molding material (F), which is mixed together from a basic molding material and a binder, and optionally, one or more additives, wherein the casting core insert (E) corresponds to a section of the casting core (G) to be produced, and wherein the casting core insert (E) carries at least one side surface section (SF1, SF2), which is equal to a corresponding section of the side surface of the casting core (G) to be produced;

(b) positioning the casting core insert (E) in the mold cavity (8) of the core box (1) in a position in which the at least one side surface section (SF1, SF2) of the casting core insert (E) occupies a place where the corresponding section of the side surface (S1, S2) of the casting core (G) is located in a finished, produced casting core (G), wherein the parting plane (T) of the core box (1) runs through intersects the at least one side surface section (SF1, SF2) of the casting core insert (E) positioned in the core box (1);

(c) introducing a casting core molding material (F), which is mixed together from a basic molding material and a binder, and optionally, one or more additives, into the mold cavity (8) of the core box (1), so as to produce the remaining a remainder of the casting core (G), wherein the casting core molding material (F) that penetrates into the mold cavity (8) comes into contact with the casting core insert (E) that sits in the mold cavity (8); and (d) solidifying the casting core molding material (F) that was introduced into the mold cavity (8), thereby forming a shape-fit and/or material-fit connection between the casting core molding material (F) that was introduced into the mold cavity (8) and the casting core insert (E).

2. The method according to claim 1, wherein the casting core molding material from which the casting core insert (E) is formed differs from the casting core molding material (F) from which the remainder of the casting core (G) is formed.

3. The method according to claim 1, wherein the casting core molding material from which the casting core insert (E) is formed is the same as the casting core molding material (F) from which the remainder of the casting core (G) is formed.

4. The method according to claim 1, wherein a surface structure having projections, recesses and/or undercuts is imparted to the casting core insert (E) during production (work step (a)), on surface sections that come into contact with the remainder of the casting core (G), on which surface sections shape-fit coupling of the casting core insert (E) with the casting core molding material (F) that comes into contact with the casting core insert (E) occurs when the casting core molding material (F) that was introduced into the core box (1) in work step (c) impacts the corresponding surface sections.

5. The method according to claim 1, wherein a volume of the casting core molding material (F) that was introduced into the mold cavity (8) of the core box (1) in work step (c) is detected, and an alarm signal is issued if the volume introduced exceeds a limit value.

6. The method according to claim 1, further comprising providing an additional molded element in the mold cavity (8), wherein the additional molded element is shielded by the casting core insert (E) with regard to a remaining part of the mold cavity (8) after positioning of the casting core insert in the mold cavity (8) (work step (b)), and monitoring whether a molded element is reproduced on the casting core (G) obtained after work step (d), wherein the molded element corresponds, at least in certain sections, to a negative of the additional molded element provided in the mold cavity (8), and if a molded element is found on the casting core (G) obtained, this casting core (G) is sorted out as a defective part.

7. The method according to claim 6, wherein the additional molded element is a recess, a projection, or a foreign body.

8. The method according to claim 1, wherein the work steps (a)-(d) are carried out repeatedly in a serial sequence, and the core box (1) comprises, in addition to the mold cavity (8) in which the casting core insert (E) is positioned in one pass of the work step sequence (a)-(d) (work step (b)) and subsequently the casting core (G) to be produced is finish-formed by introduction of the casting core molding material (F) (work step (c)), an additional mold cavity (9) in which a new casting core insert (E') is formed, at the same time when the casting core molding material (F) is filled into the mold cavity provided for the casting core (G) (work step (c)), which insert is required for a next pass to be carried out (work step (a) of a subsequent pass of the work steps (a)-(d)).

* * * * *